US005954486A

United States Patent [19]

Iwata

[11] Patent Number: 5,954,486

[45] Date of Patent: Sep. 21, 1999

[54] SQUEEZE PUMP HAVING SHRINK FITTER ROLLERS

[75] Inventor: Noboru Iwata, Hashima, Japan

[73] Assignee: Daiichi Techno Co., Ltd., Japan

[21] Appl. No.: 08/886,686

[22] Filed: Jul. 1, 1997

[51] Int. Cl.[6] ..... F04B 43/08

[52] U.S. Cl. ..... 417/477.3; 417/900

[58] Field of Search ..... 417/477.3, 477.12, 417/900; 92/92

[56] References Cited

U.S. PATENT DOCUMENTS

| | | | |
|---|---|---|---|
| 3,955,902 | 5/1976 | Kyvsgaard | 417/477.3 |
| 4,492,538 | 1/1985 | Iwata . | |
| 4,632,646 | 12/1986 | Iwata | 417/900 |
| 4,730,933 | 3/1988 | Lohr . | |
| 4,730,993 | 3/1988 | Iwata | 417/900 |
| 5,533,878 | 7/1996 | Iwata | 417/477.3 |

FOREIGN PATENT DOCUMENTS

| | | |
|---|---|---|
| 39099/85 | 2/1985 | Australia . |
| 2 076 068 | 11/1981 | United Kingdom . |

*Primary Examiner*—Charles G. Freay
*Attorney, Agent, or Firm*—Quarles & Brady

[57] ABSTRACT

A squeeze type pump, which transfers slurry via an elastic tube by squeezing the elastic tube with pairs of rollers to elastically deform the tube while moving each pair of squeezing rollers. The squeeze type pump includes a cylindrical drum with the elastic tube being arranged along an inner surface of the drum. A drive shaft is supported at a center portion of the drum while pairs of support shafts are cantilevered by the drive shaft. Bearings rotatably support the rollers on each support shaft. The squeezing rollers are formed from a synthetic resin material.

23 Claims, 10 Drawing Sheets

SQUEEZE PUMP HAVING SHRINK FITTER ROLLERS

BACKGROUND OF THE INVENTION

The present invention relates to a squeeze type pump, which transfers slurry such as freshly mixed concrete, and more particularly, to a squeeze type pump including pairs of squeezing rollers, which squeeze an elastic tube to elastically deform the tube and transfer slurry via the elastic tube.

A prior art squeeze type pump includes an elastic tube, which is arranged in a U-shaped manner along the inner surface of a cylindrical drum. A pair of support arms are mounted on a drive shaft that is inserted through a center of the drum. The support arms are separated from each other by an angle of 180 degrees and rotate synchronously. A pair of squeezing rollers are supported at a distal portion of each support arm by means of a support shaft and a bearing. The rollers squeeze the elastic tube from each side of its outer surface to elastically deform the tube into a flat shape.

The pairs of squeezing rollers squeeze the elastic tube to move concrete that is in front of the rollers through the tube along the revolving direction of the rollers. Furthermore, the succeeding pair of rollers revolve and squeeze the elastic tube to move concrete sealed within the tube between the preceding rollers and the succeeding rollers along the revolving direction of the rollers. Concrete is thus pumped out successively.

The squeezing rollers of the prior art pump are formed from steel and are heavy. Furthermore, since steel has high heat conductivity, the rollers quickly transmit heat, which is produced by contact between the rollers and the elastic tube, toward a shaft bore defined in each roller. This structure causes quick wear of the bearings, which are arranged between the support shafts and the squeezing rollers.

Furthermore, the prior art squeeze type pump includes a seal, which prevents leakage of concrete into a receiving recess defined in each squeezing roller to receive the bearings in case the elastic tube is ruptured. This structure increases the temperature of the receiving recess and causes early wear of the bearings.

SUMMARY OF THE INVENTION

Accordingly, it is an objective of the present invention to provide a squeeze type pump capable of improving the wear resistance of bearings that support squeezing rollers.

Furthermore, it is another objective of the present invention to provide a squeeze type pump capable of improving wear resistance of an elastic tube.

A squeeze type pump according to the present invention transfers slurry via an elastic tube by squeezing the elastic tube with pairs of rollers to elastically deform the tube while moving each pair of squeezing rollers. The squeeze type pump includes a cylindrical drum and the elastic tube is arranged along an inner surface of the drum. A drive shaft is supported at a center portion of the drum. Pairs of support shafts are cantilevered by the drive shaft. Bearings rotatably support the rollers on each support shaft. The squeezing rollers are formed from a synthetic resin material. This structure prevents heat transmission from the squeezing rollers to the bearings to prevent wear of the bearings.

BRIEF DESCRIPTION OF THE DRAWINGS

The features of the present invention that are believed to be novel are set forth with particularly in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a squeeze type pump according to the present invention will now be described with reference to FIGS. 1 to 12.

Figure 11:
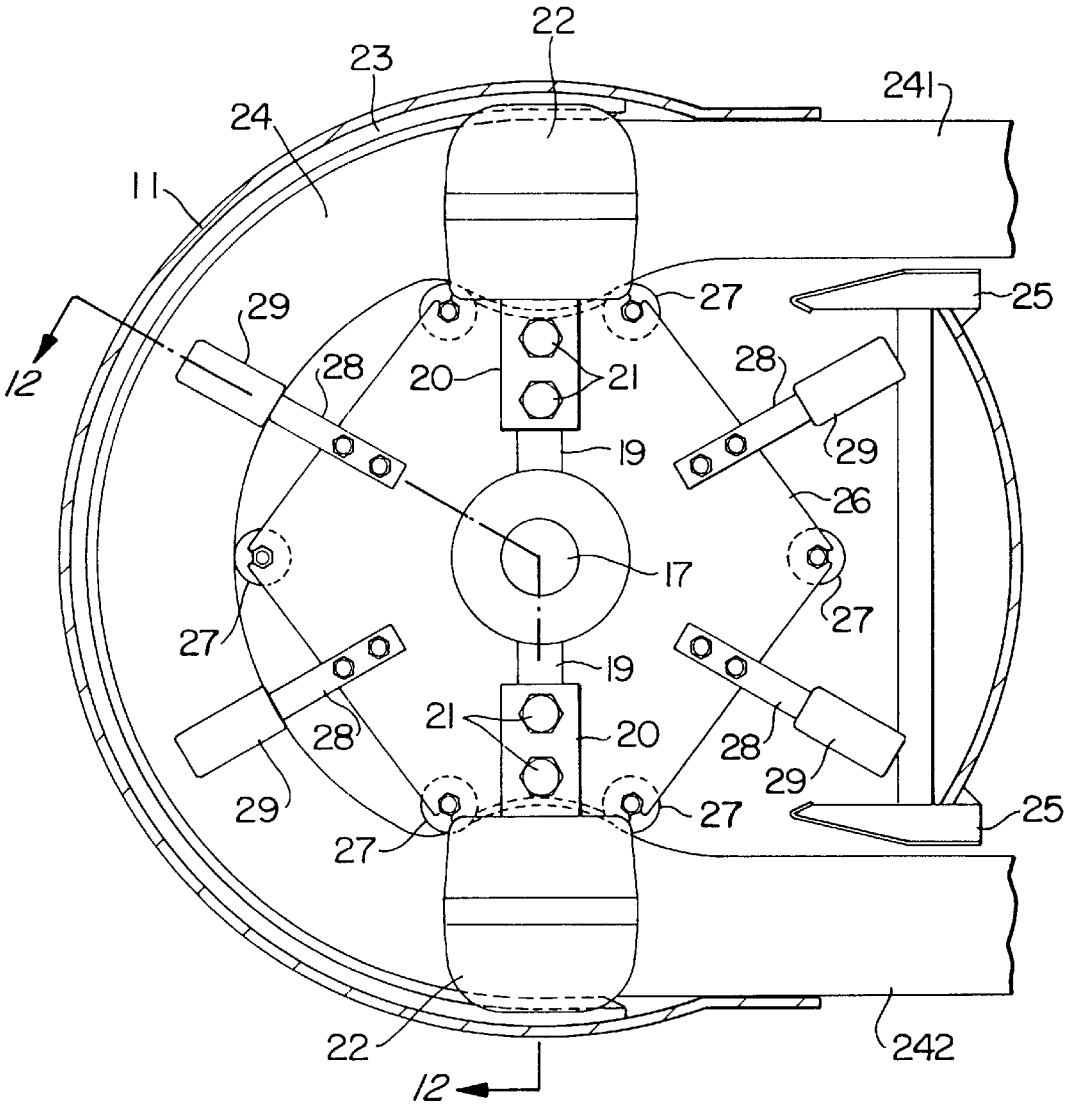
FIG. 11 is a cross-sectional view showing the squeeze type pump.
Figure 12:
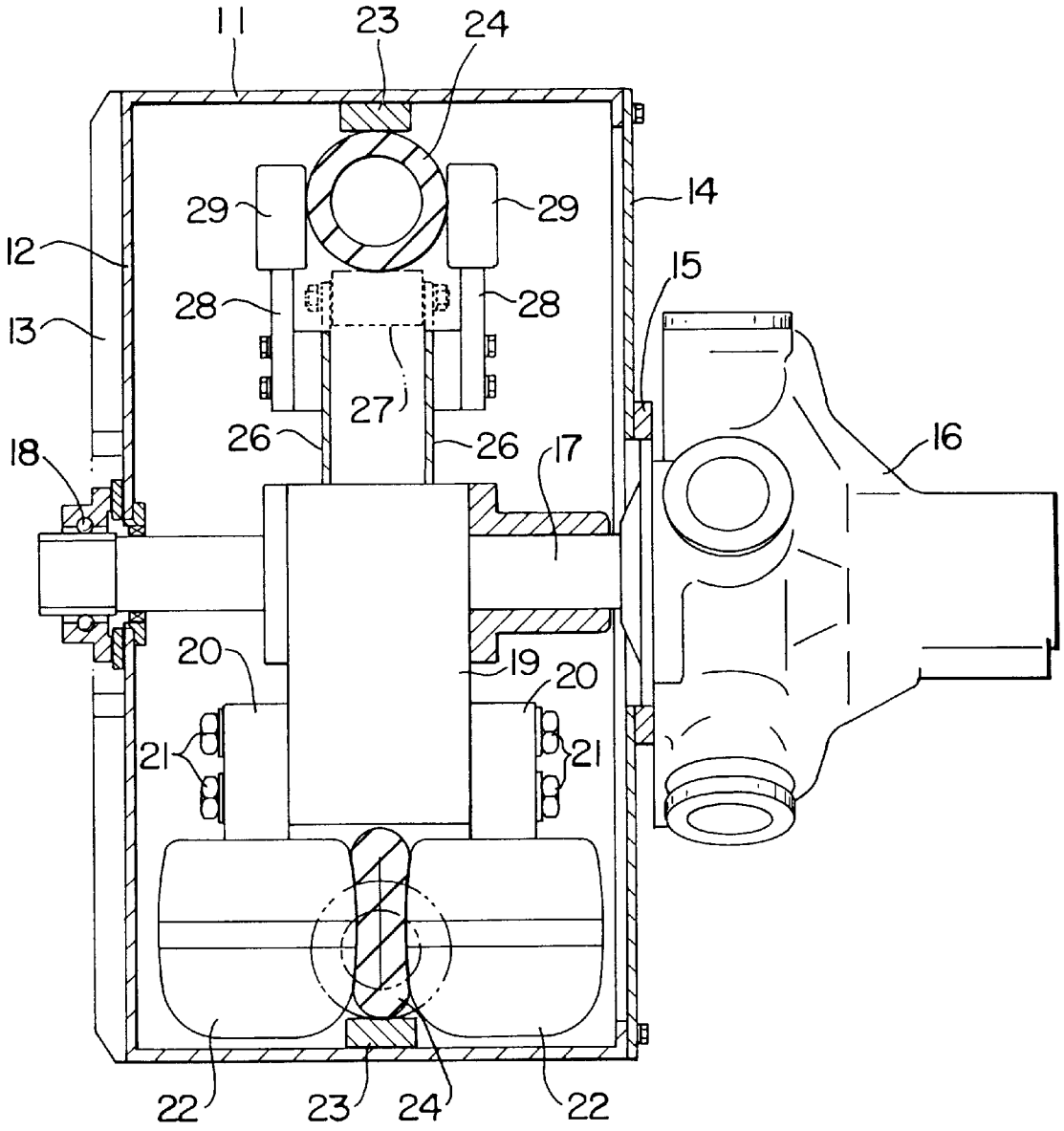
FIG. 12 is a cross-sectional view of the squeeze type pump taken along line 12—12 in FIG. 11.

The entire structure of the squeeze type pump will now be described. As shown in FIGS. 11 and 12, a cylindrical drum 11 is fixed to a vehicle (not shown), which transports the squeeze type pump. As shown in FIG. 12, a side plate 12 is formed integrally with a left end portion of the drum 11. A reinforcing rib 13 is welded to the outer surface of the side plate 12. A cover plate 14 is secured to the right end portion of the drum 11 by bolts to cover an opening. An attachment plate 15 secures a hydraulic motor 16, which is inserted in an opening defined at the center of the cover plate 14. The motor 16 includes a drive shaft 17, which extends through a center portion of the drum 11. A distal portion of the drive shaft 17 is supported by a center portion of the side plate 12 by a radial bearing 18.

As shown in FIG. 11, a pair of straight support arms 19 are coupled to a middle portion of the drive shaft 17. The support arms 19 are separated from each other by an angle of 180 degrees. As shown in FIG. 12, a pair of support shafts 20, which extends parallel with each other, are fastened to each side of a distal portion of each support arm 19 by bolts 21. A squeezing roller 22 is rotatably supported by each support shaft 20 to squeeze an elastic tube 24.

A substantially semicircular supporter 23 is fixed, for example, by means of welding, to the inner surface of the drum 11. The elastic tube 24, which is formed from rubber, is arranged along the inner surface of the supporter 23. As shown in FIG. 11, the elastic tube 24 includes an inlet portion 241, which extends horizontally from an upper part of the drum 11. The inlet portion 241 is connected to a concrete hopper (not shown) by a suction piping. An outlet portion 242 of the elastic tube 24 extends horizontally from a lower part of the drum 11 and is connected to a discharge piping. Concrete is thus provided to a construction site. A guide member 25 guides the elastic tube 24.

A pair of polygonal attachment plates 26 are mounted on the drive shaft 17. The attachment plates 26, which extend parallel to each other, are arranged in the axial direction of the drive shaft 17 with a predetermined interval therebetween. The attachment plates 26 are welded to the drive shaft 17. Rollers 27 are rotatably supported by opposing corner portions of the attachment plates 16 to contact the inner side of the elastic tube 24 and restore the cylindrical shape of the flattened tube.

A plurality of opposing support arms 28 are attached to the outer surface of each attachment plate 26. A restricting roller 29 is rotatably supported to each arm 28 for restricting the position of the outer surface of the elastic tube 24.

Figure 2:
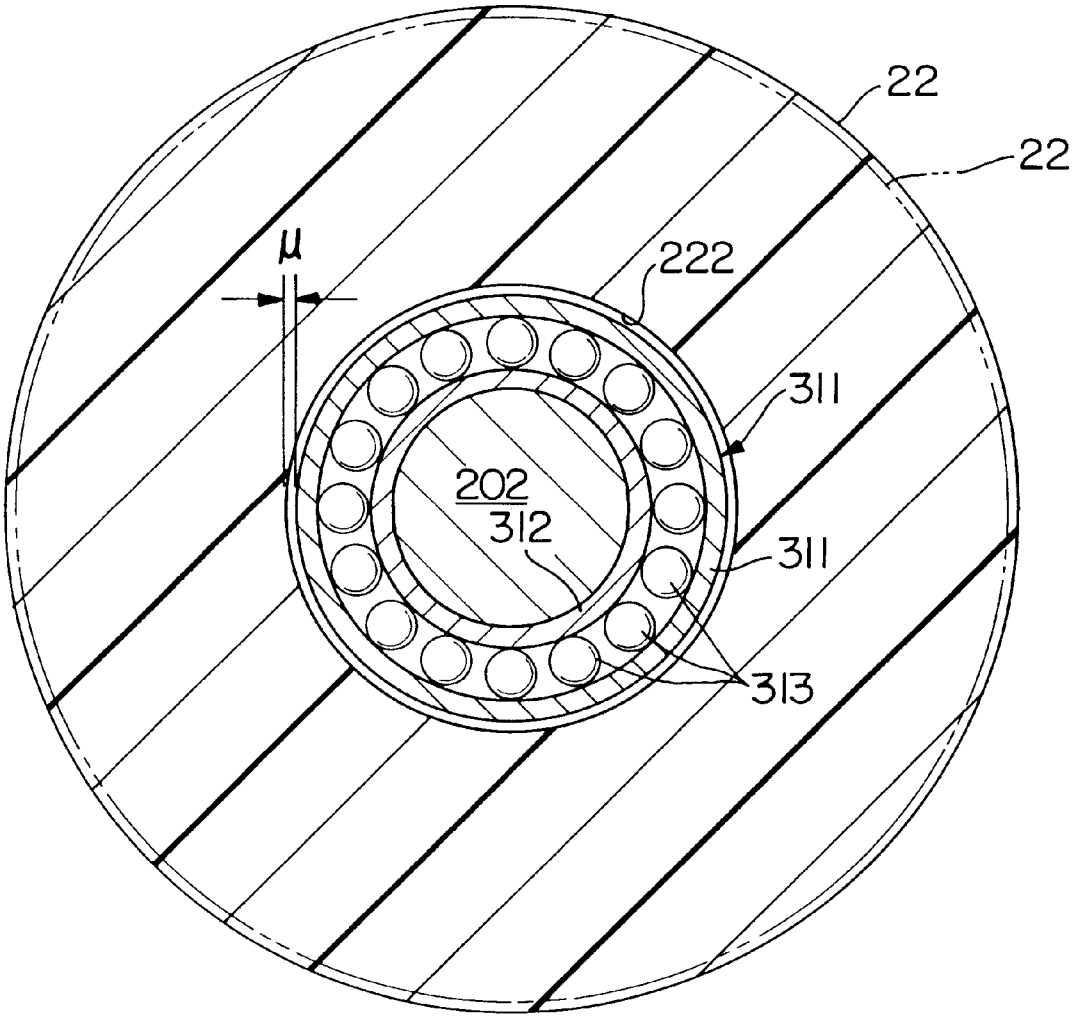
FIG. 2 is a horizontal cross-sectional view showing the squeezing roller to be shrink fitted to the bearings.
Figure 3:
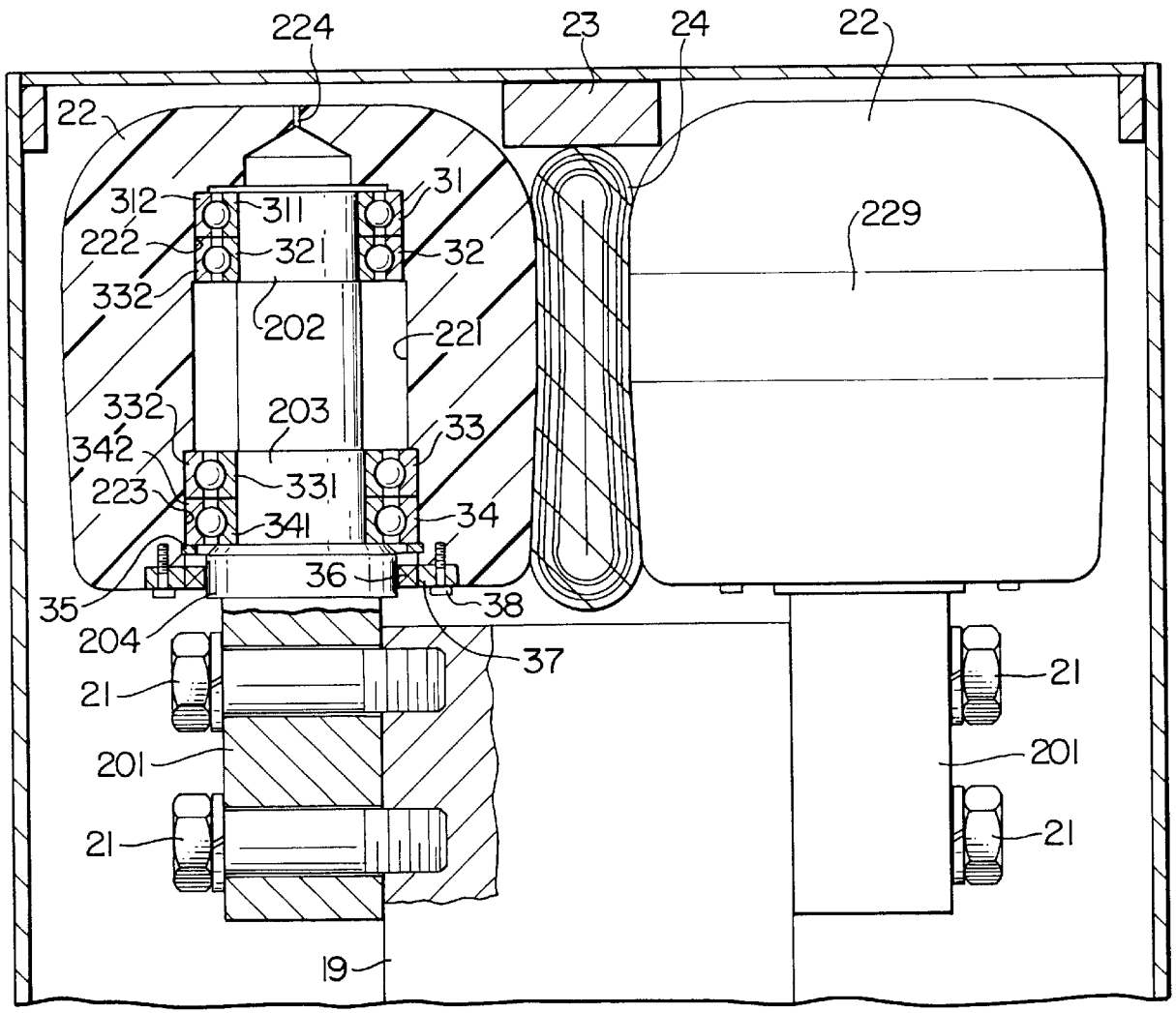
FIG. 3 is a partial sectional view showing a pair of squeezing rollers in an assembled state.
Figure 4:
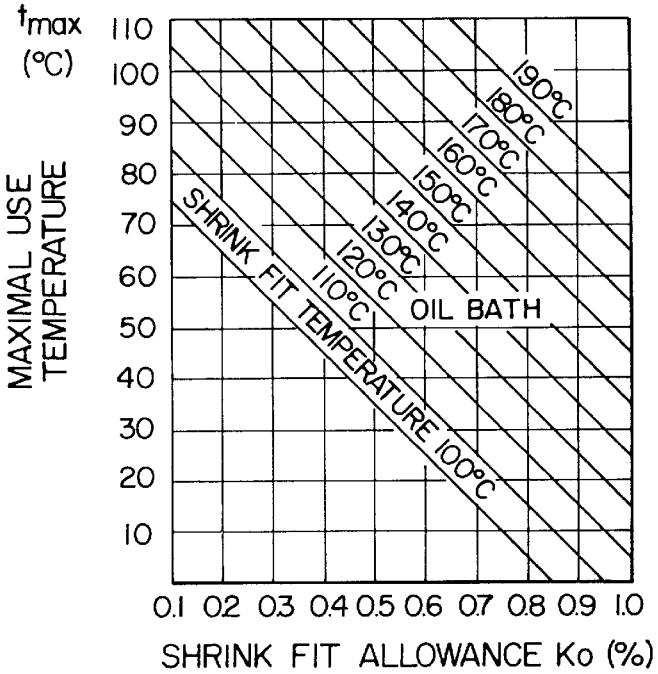
FIG. 4 is a graph used for determining shrink fit temperature based on shrink fit allowance and maximal use temperature.

The squeezing rollers 22 and their bearing structures will now be described with reference to FIGS. 1 to 3. As shown in FIG. 3, the squeezing roller 22 is formed from synthetic resin and is rotatably supported by the support shaft 20 by a first radial ball bearing 31, a second radial ball bearing 32, a third radial ball bearing 33, and a fourth radial ball bearing 34 (hereinafter referred to as the first to fourth bearings). Needle bearings or journal bearings may be used in lieu of the bearings 31 to 34.

Each support shaft 20 includes a rectangular parallelopiped attaching portion 201, which is fastened to one side of the support arm 19 by bolts 21. A small diameter portion 202 and a large diameter portion 203 are formed integrally with the attaching portion 201. Inner races 311, 321 are fitted to the small diameter portion 202 of the first and second bearings 31, 32, respectively. Inner races 331, 341 are fitted to the large diameter portion 203 of the third and fourth bearings 33, 34, respectively. A flange 204 is formed integrally with the portion between the attaching portion 201 and the large diameter portion 203 to receive thrust load, which acts on the third and fourth bearings 33, 34. A thrust bearing may be used to receive the load.

Figure 1:
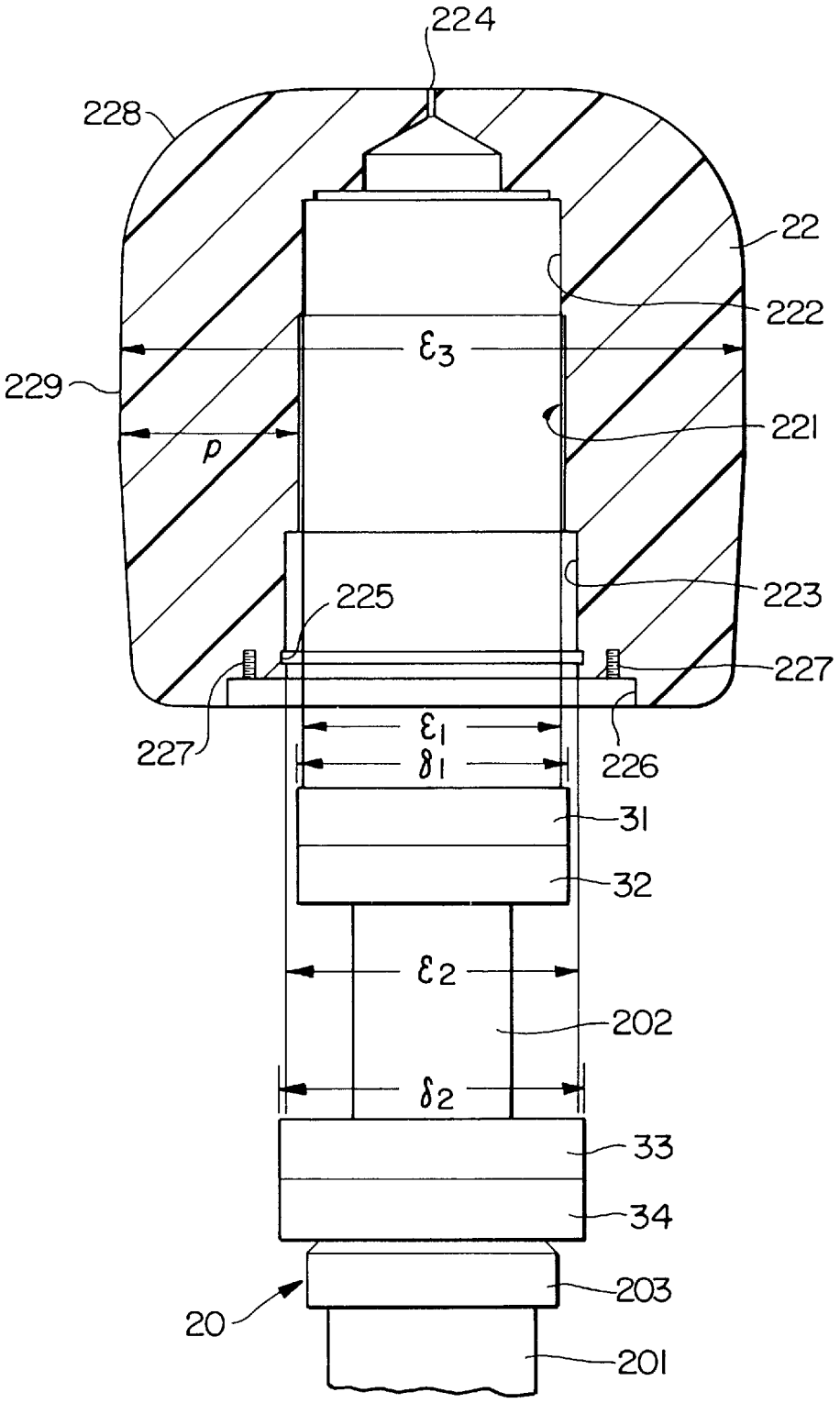
FIG. 1 is a vertical cross-sectional view showing a squeezing roller, which is to be shrink fitted to bearings, used for a squeeze type pump according to the present invention.

As shown in FIG. 1, a shaft bore 221 is defined in the center of each squeezing roller 22. A first receiving bore 222 is arranged at a position near the inner end of the shaft bore 221. The receiving bore 222 is to be shrink fitted to the outer surfaces of outer races 312, 322 of the first and second bearings 31, 32. A second receiving bore 223 is arranged at a position near an opening of the shaft bore 221. The receiving bore 223 is to be shrink fitted to the outer surfaces of outer races 332, 342 of the third and fourth bearings 33, 34.

A small diameter hole 224 is provided at the distal end of each squeezing roller 22. The small diameter hole 224 discharges air from the shaft bore 221, when the squeezing roller 22 is shrink fitted to the first to fourth bearings 31 to 34. The small diameter hole 224 is sealed with synthetic resin after the squeezing rollers 22 are shrink fitted to the bearings 31 to 34.

As shown in FIGS. 1 and 3, an engaging groove 225 is defined along the inner surface of the shaft bore 221 of each squeezing roller 22 at a position adjacent to the opening of the bore 221. A U-shaped stop ring 35 is engaged with the groove 225 to restrict the position of the outer race 342 of the fourth bearing 34. A fitting recess 226 and a plurality of bolt holes 227 are provided at a proximal portion of the squeezing roller 22. A seal holder 37 is fitted in the fitting recess 226 by bolts 38, which are screwed in the bolt holes 227. The seal holder 37 holds a seal member 36 at a predetermined position. The seal member 36 is thus retained at a position between the outer surface of the flange 204 of the support shaft 20 and the opened end of the shaft bore 221 of the squeezing roller 22.

The synthetic resin material used for the squeezing rollers 22 will hereafter be described. In this embodiment, the synthetic resin material is selected from a plurality of monomer casting nylons [produced by Meiwa Kasei Kabushiki Kaisha, product name: UBE UMC (UBE Monomer Casting) Nylon], as shown in Table 1. The material contains caprolactam and alkali catalyst as starting materials. UMCs are engineering plastics, a basic component of which is nylon 6.

The starting materials are cast into metal molds in the same manner as metal molding and then polymerized in the metal molds. The polymerized materials are then formed in accordance with a shape of a cavity that is defined by each metal mold. Particularly, the starting materials are chosen to form squeezing rollers that have improved resistance against wear, heat, impact or the like.

Table 1 shows properties of products formed from different monomer casting nylons, i.e., compressive strength, hardness, and heat conductivity thereof. These parameters have been measured in accordance with D696, D695, D785, and C-177 of ASTM (American Society for Testing Materials).

TABLE 1

| Materials Properties | UMC-1 Normal | UMC-2 Soft | UMC-3 Wear resistant | UMC-4 High sliding | UMC-6 High heat resisting |
|---|---|---|---|---|---|
| Coefficient of linear expansion × $10^{-5}$/° C. | 7.8 | NA | 6.5 | 8.5 | 7.0 |
| Compressive Strength kg/cm | 900–1300 | 300–500 | 700–800 | 750–900 | 1000–1200 |
| Rockwell hardness (R scale) | 118–120 | 95–105 | 110–120 | 105–110 | 120–125 |

TABLE 1-continued

| Materials Properties | UMC-1 Normal | UMC-2 Soft | UMC-3 Wear resistant | UMC-4 High sliding | UMC-6 High heat resisting |
|---|---|---|---|---|---|
| Heat resisting temperature ° C. | 130–150 | 80–110 | 130–150 | 130–150 | 150–170 |
| Heat conductivity × $10^{-4}$ cal/cm ° C. sec | 5.5 | NA | 5.8 | 6.4 | 4.8 |
| Feasibility | Feasible | Not feasible | Feasible | Feasible | Feasible |

NA: Not Available

As shown in Table 1, casting nylon UMC-2 has low compressive strength and low heat resistance. Thus, it is preferable that UMC-2 not be the material of the squeezing rollers 22. Any of UMC-1, UMC-3, UMC-4, and UMC-6 may be selected as the material of the rollers.

The process for shrink fitting the first to fourth bearings 31 to 34 into the shaft bore 221 of each squeezing roller 22 will hereafter be described. As shown in FIG. 1, the outer diameters $\delta_1$ of the first and second bearings 31, 32 are larger than the inner diameter $\epsilon_1$ of the first receiving bore 222 of the squeezing roller 22 under normal temperatures, before the squeezing roller 22 is shrink fitted to the bearings 31–34. In the same manner, the outer diameters $\delta_2$ of the third and fourth bearings 33, 34 are larger than the inner diameter $\epsilon_2$ of the second receiving bore 223 of the squeezing roller 22.

To determine a standard shrink fit dimension between each squeezing roller 22 and the bearings 31 to 34, the inner diameter $\epsilon_1$ ($\epsilon_2$) of the bearing receiving bore 222 (223) of the squeezing roller 22 is subtracted from the outer diameter $\delta_1$ ($\delta_2$) of the bearings, and the resulting value is divided by two. A standard shrink fit allowance Ko, or the ratio of the standard shrink fit dimension to the outer diameter $\delta_1$ of the bearings, is determined by the following equation:

$$Ko(\%)=(\text{standard shrink fit dimension/outer diameter of the bearings})\times 100$$

If the casting nylon (UMC-1) is used, a standard shrink fit allowance Ko is set within a range of 0.3 to 0.6% of the outer diameter $\delta_1$ ($\delta_2$) of the bearings 31, 32 (33, 34) at a maximum use temperature of the roller 22.

If, for example, the outer diameter $\delta_1$ of the first and second bearings 31, 32 is 125 mm, the inner diameter $\epsilon_1$ of the first receiving bore 222 is set within a range of 124.25 to 124.50 mm. In such cases, the standard shrink fit dimension is set within a range of 0.5 to 0.75 mm. Furthermore, the standard shrink fit allowance Ko, or the ratio of the standard shrink fit dimension to the outer diameter $\delta_1$ ($\delta_2$) of the bearings 31 to 34 is set within a range of 0.4 to 0.6%.

Normally, there is a great difference between the minimal use temperature and the maximal use temperature of the squeezing roller 22. The actual shrink fit allowance K1 is affected by the minimal and maximal use temperatures and is thus corrected in accordance with these temperatures. When the maximal use temperature is $t_{max}$ and the minimal use temperature is $t_{min}$, the actual shrink fit allowance K1 is determined by the following equation, on the condition that the actual allowance K1 is smaller than 1.0%:

$$K1(\%)=Ko+0.01(t_{max}-t_{min})<1.0$$

Oil (e.g., product name: Nisseki Hitherm #80) is used as a heat medium for the shrink fit process. The process is performed using well-stirred oil. The heating temperature of the oil is determined in accordance with a graph of FIG. 4, in which maximal use temperature $t_{max}$ is plotted against shrink fit allowance Ko. For example, if the standard shrink fit allowance Ko is 0.6% and maximal use temperature $t_{max}$ is 100 degrees Celsius, the shrink fit temperature is set within a range of 170 to 180 degrees Celsius.

Figure 5:
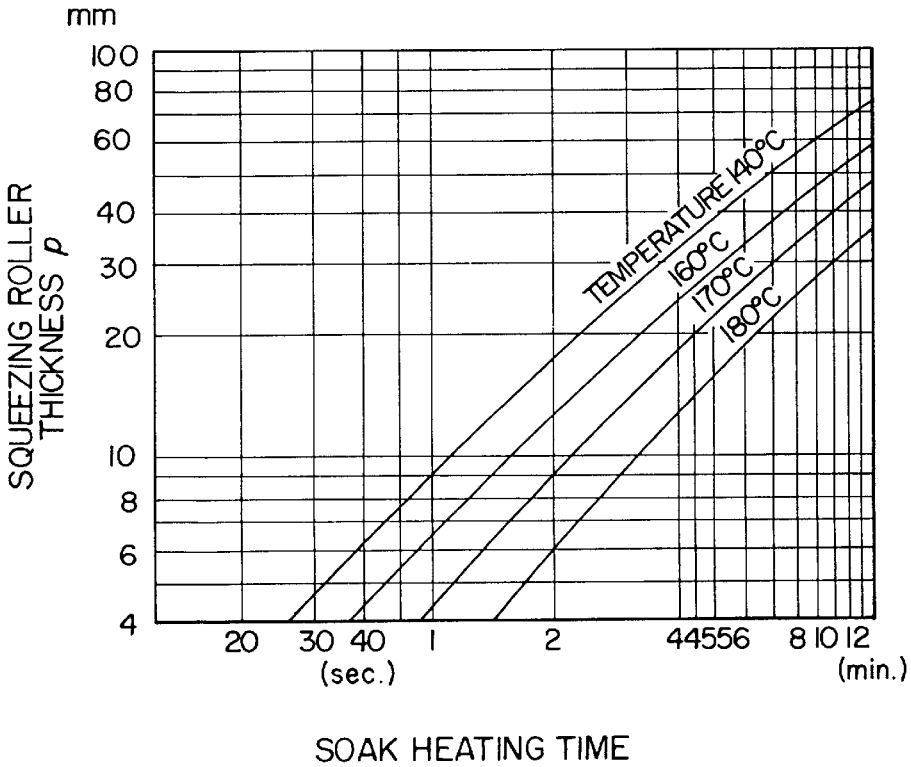
FIG. 5 is a graph used for determining heating time based on thickness of the squeezing roller and shrink fit temperature.

The heating time required for the shrink fit process is determined in accordance with a graph of FIG. 5, in which the thickness ⊀ (mm) of the squeezing roller 22 is plotted against soak heating time. For example, if the thickness ρ of the squeezing roller 22 is set within a range of 20 to 30 mm and the heating temperature is set within a range of 170 to 180 degrees Celsius, the heating time is set within a range of 4.5 to 10.0 minutes. Normally, the heating time is set within a range of 3 to 10 minutes.

When heated to a shrink fit temperature of 180 degrees Celsius in accordance with the above conditions, the squeezing roller 22 expands by approximately 2%. In this state, as shown by a solid line in FIG. 2, the inner diameter $\epsilon_1$ of the bearing receiving bore 222 of the squeezing roller 22 is larger than the outer diameters $\delta_1$ of the first and second bearings 31, 32. Marginal space $\mu$ (0.5 to 2.0 mm) is thus defined therebetween. This structure allows smooth insertion of each bearing 31, 32, 33, 34 into the bearing receiving bore 222. After the bearings are inserted into each squeezing roller 22, the roller 22 is cooled down to the normal temperature. The squeezing rollers 22 are thus compressed. The inner surfaces of the bearing receiving bores 222, 223 are then firmly pressed against the outer surfaces of the bearings 31 to 34. Therefore, the squeezing roller 22 is firmly secured to the bearings.

In this manner, each squeezing roller 22 is shrink fitted to the bearings 31 to 34. If the squeezing rollers 22 are loosely engaged with the bearings 31 to 34, the bearings become unstable in the squeezing rollers 22 while the pump is activated. This hinders smooth rotation of the rollers and reduces the durability of the rollers.

As shown in FIG. 1, a middle portion 229 of each squeezing roller 22 has a certain outer diameter $\epsilon_3$, which becomes smaller toward the proximal end and the distal end of the roller 22. Furthermore, a distal portion 228 of the squeezing roller 22 has a rounded outer surface. Therefore, the squeezing roller 22, as a whole, has a shape that varies radially. As shown in FIG. 3, the middle portions 229 of two squeezing rollers 22 include outer surfaces which are opposed to each other. The tube 24 is squeezed therebetween to a substantially uniform thickness.

Figure 10:
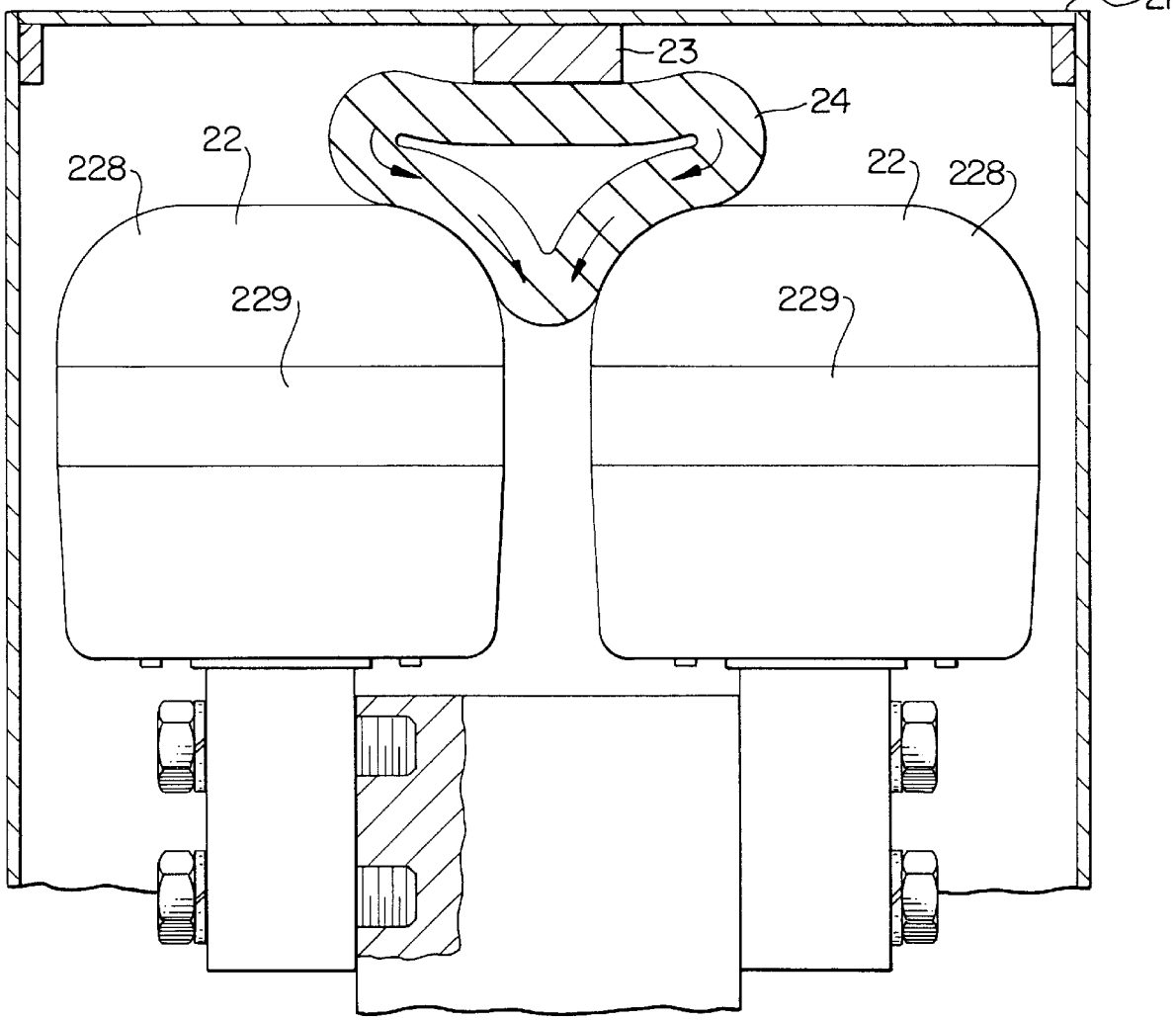
FIG. 10 is a cross-sectional view showing the elastic tube in an initial squeezing state.

As shown in FIG. 10, the distal portion 228 of each squeezing roller 22 contacts the elastic tube 24 only when the rollers 22 start clamping the tube 24. Therefore, although the distal portion 228 needs to be rounded, the distal portion 228 need not be thick. However, if the thickness ρ of the middle portion (operating section) 229, which constantly squeezes the elastic tube 24, is small, a temperature gradient between the outer surface and the inner surface of each roller 22 becomes small. This increases the heat transferred from each squeezing roller 22 to the bearings 31 to 34. Since heat causes the bearings 31, 32, 33, 34 to become loose in the rollers 22, the bearings may become unstable or damaged. Furthermore, when the thickness ρ of the middle portion 229 is small, the force for gripping the bearings 31 to 34 becomes smaller. This may cause the bearings 31 to 34 to become loose while the squeeze type pump is activated.

Considering these conditions, the thickness ρ of each squeezing roller 22 needs to be 10 mm or larger, which is sufficient to maintain the bearings 31 to 34 in a shrink fitted state. Furthermore, the dimension ratio of the thickness ρ of the squeezing roller 22 to the outer diameter $\epsilon_3$ of the squeezing roller 22 ($\rho/\epsilon_3$) is preferred to be 0.1 or larger. However, when each roller 22 has a constant outer diameter, it is preferred that the dimension ratio not be larger than 0.4, since this would reduce the mechanical strength of the bearings 31 to 34.

Figure 6:
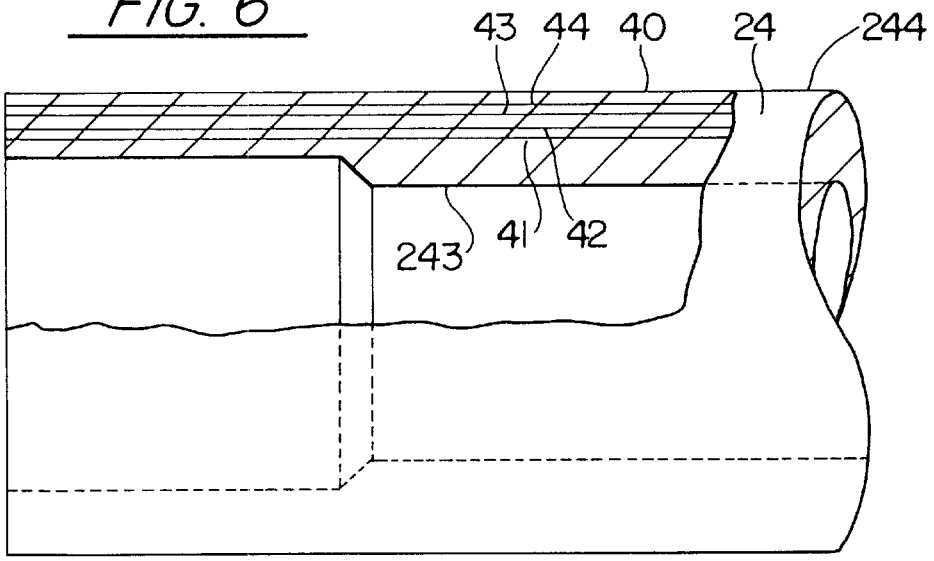
FIG. 6 is a partial cross-sectional view showing the elastic tube.

The structure of the elastic tube 24 will now be described. As shown in FIG. 6, the elastic tube 24 includes a cylindrical tube body 40, which is formed from rubber, and first, second, third, and fourth reinforcing layers 41, 42, 43, 44. The first to fourth reinforcing layers 41 to 44 are embedded concentrically in the body 40. The tube body 40 is formed from wear resistant and weather resistant rubber, which has, for example, the composition shown in Table 2.

TABLE 2

| Element | Content (Parts by weight) |
|---|---|
| Natural rubber | 50 |
| Styrene-butadiene rubber | 50 |
| Carbon black | 50 |
| Zinc white | 5 |
| Softener | 5 |
| Processing aid | 3 |
| Sulfur | 2 |
| Vulcanization accelerator | 1 |
| Stearic acid | 2 |
| Antioxidant | 1 |

Figure 8:
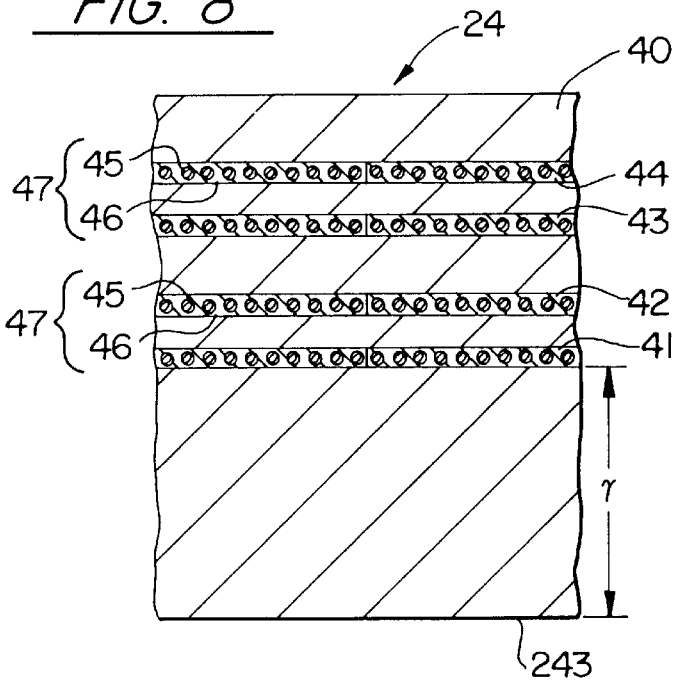
FIG. 8 is a partially enlarged cross-sectional view showing the elastic tube.

As shown in FIG. 8, the reinforcing layers 41 to 44 are constituted by elongated synthetic fiber cords 47. Each synthetic fiber cord 47 includes a plurality of nylon threads 45 and rubber 46, which encompasses the nylon threads 45. The nylon threads 45 are arranged in a plane with an interval between one another. The nylon threads 45 are formed from nylon 6 or nylon 66, while the rubber 46 is formed from natural rubber or styrene-butadiene rubber.

The thickness of each synthetic fiber cord 47 is set within a range of 0.6 to 1.2 mm, while its width is set within a range of 200 to 500 mm, preferably from within a range of 300 to 400 mm. The synthetic fiber cords 47 of the first and the second reinforcing layers 41, 42 extend helically about the axis of the tube in a clockwise direction and in a counter-clockwise direction, respectively. In the same manner, the synthetic fiber cords 47 of the third and the fourth reinforcing layers 43, 44 extend helically in opposite directions.

The reinforcing layers 41 to 44 are embedded in the elastic tube body 40 in an angle (angle of repose) of 54'44"with respect to the axis of the tube. The angle is preferably set within a range of about 50 to about 60 degrees. This prevents expansion of the elastic tube 24 which is caused by stress that is applied by slurry moving through the tube. The durability of the elastic tube is thus improved.

Figure 7:
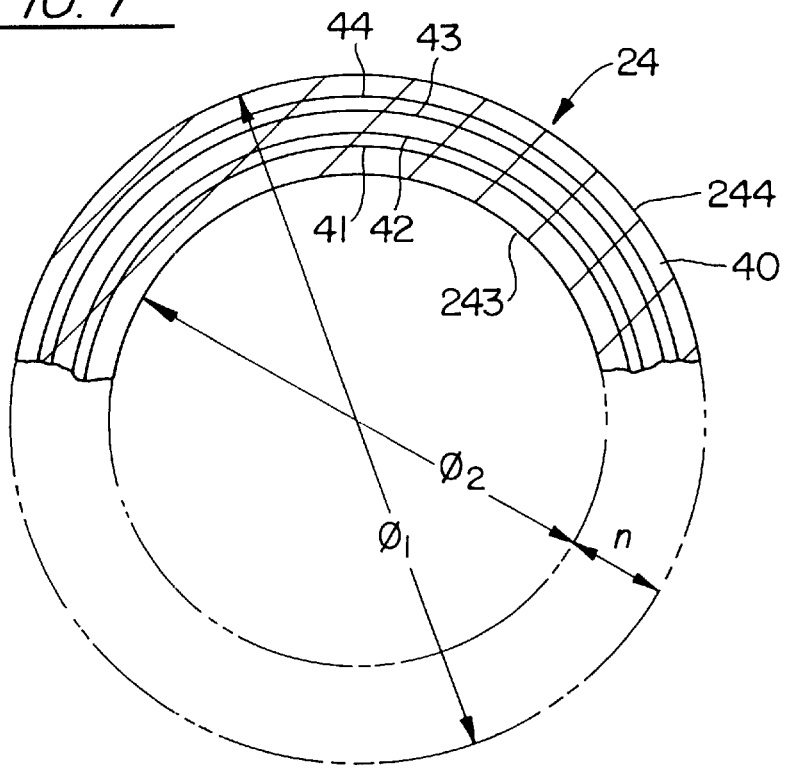
FIG. 7 is a partial horizontal cross-sectional view showing the elastic tube.

As shown in FIG. 7, the dimension ratio of the diameter of the outer surface 244 (hereinafter referred to as outer diameter $\phi_1$) and the diameter of the inner surface 243 (hereinafter referred to as inner diameter $\phi_2$) of the elastic tube 24 ($\phi_2/\phi_1$) is set within a range of 0.56 to 0.72. The elastic tube 24 is thus squeezed in an optimal manner, as shown in FIG. 10, during an initial period of squeezing by the squeezing rollers 22. The basis for selecting the dimension ratio will hereafter be described.

An experiment was performed using a first elastic tube and a second elastic tube to move concrete therethrough. The first elastic tube had an outer diameter $\phi_1$ set at 159.0 mm, and an inner diameter $\phi_2$ set at 101.6 mm. The second elastic tube had an outer diameter $\phi_1$ set at 165.0 mm, and an inner diameter $\phi_2$ set at 105.0 mm. In the experiment, each elastic tube was squeezed in an optimal manner by the squeezing rollers (see Table 3).

Furthermore, when the outer diameter $\phi_1$ of the elastic tube was set at either 159.0 mm or 165.0 mm with the thickness η of the elastic tube 24 set within a range of 23.0 mm to 35.0 mm, the elastic tube was also squeezed in an optimal manner.

TABLE 3

| Tube No. | Outer diameter $\phi_1$ mm | Inner diameter $\phi_2$ mm | Thickness η mm | Dimension ratio $\phi_2/\phi_1$ | Feasibility |
|---|---|---|---|---|---|
| 1 | 159.0 | 101.6 | 28.7 | 0.64 | Feasible |
| 2 | 165.0 | 105.0 | 30.0 | 0.64 | Feasible |
| 3 | 159.0 | 113.0 | 23.0 | 0.71 | Feasible |
| 4 | 159.0 | 89.0 | 35.0 | 0.56 | Feasible |
| 5 | 165.0 | 119.0 | 23.0 | 0.72 | Feasible |
| 6 | 165.0 | 95.0 | 35.0 | 0.58 | Feasible |

Therefore, the dimension ratio ($\phi_2/\phi_1$) of the elastic tube is preferably set within a range of 0.56 to 0.72. More preferably, the dimension ratio ($\phi_2/\phi_1$) is set within a range of 0.60 to 0.68. The thickness η of the elastic tube is preferably set within a range of 23 to 35 mm, and more preferably, within a range of 28 to 30 mm.

If the thickness η of the elastic tube 24 exceeds 35 mm, the adhered surfaces of the reinforcing layers 41, 42, 43, 44 may easily separate from the rubber body 40. If the thickness η is smaller than 23 mm, the force for restoring the original shape of the flattened elastic tube 24 may be reduced. Furthermore, in such cases, heat may cause the adhered surfaces to separate from the body 40.

Figure 9:
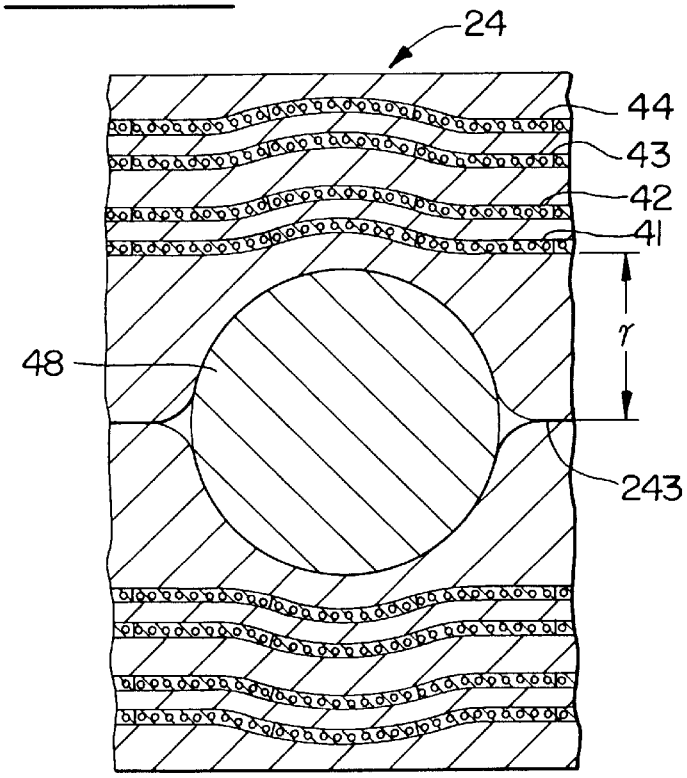
FIG. 9 is a partial cross-sectional view showing a foreign body caught in the elastic tube.

As shown in FIG. 8, the thickness γ of a rubber layer, which is defined by the innermost reinforcing layer, or the first reinforcing layer 41 and the inner surface 243 of the tube 24, is set within a range of 10 to 15 mm. As shown in FIG. 9, the rubber layer prevents a foreign body 48 from cutting the first reinforcing layer 41 of the elastic tube 24, when the foreign body 48 is caught in the tube 24.

In a squeeze type pump constructed as above, as shown in FIG. 12, the drive shaft 17 of the motor 16 rotates to cause integral revolution of the support arms 19, the squeezing rollers 22, the restoring rollers 27 and the position restricting rollers 29. Each pair of squeezing rollers 22 revolves about the drive shaft 17 while squeezing the tube 24 in a flat shape. Concrete, which is located at a position in front of the pair of squeezing rollers 22, thus moves from the inlet portion 241 toward the outlet portion 242. This structure transfers concrete from a supply source to a desired location.

Operations and effects of this embodiment, which is constructed as described above, will hereafter be described with reference to its structure.

In this embodiment, the squeezing rollers 22, which are supported to the support shafts 20 by the bearings 31–34, are formed from synthetic resin. The heat conductivity of the rollers is thus reduced. This makes it difficult to transmit heat, which is produced at the outer surface of each roller, toward the shaft bore 221 of the roller. This structure prevents the fitted bearings 31 to 34 from being exposed to heat. Therefore, deterioration of the bearings is prevented and the bearing life is improved.

The squeezing rollers 22 are formed from monomer casting nylon produced by polymerizing resin material, which is cast in a metal mold. This facilitates the production of the rollers 22. As shown in Table 1, the squeezing rollers 22 are formed from resin that has an expansion coefficient set within a range of 6.5 to $8.5\times10^{-5}$/° C. This facilitates shrink fitting of the bearings 31 to 34 into the squeezing rollers 22.

The squeezing rollers are formed from resin, the heat conductivity of which is set within a range of 4.8 to $6.4\times10^{-4}$cal/cm° C.sec. This prevents the bearings 31 to 34 from being exposed to a high temperature. Deterioration of the bearings 22 is thus prevented and the bearing life is thus improved. Furthermore, the squeezing rollers are formed from resin, the Rockwell hardness of which is set within a range of 105 to 125. This improves the resistance of the rollers against wear and impact.

The squeezing rollers are formed from resin, the heat resisting temperature of which is set within a range of 120 to 170 degrees Celsius. Therefore, the squeezing rollers will resist heat to the maximal use temperature of the squeeze type pump, which is 100 degrees Celsius. Furthermore, the squeezing rollers 22 are formed from resin, the compressive strength of which is set within a range of 700 to 1300 kg/cm. This improves the resistance of the rollers 22 against wear and impact.

During the shrink fit process, the squeezing rollers 22 are heated to a temperature higher than the maximal use temperature of the squeeze type pump. The bearings 31 to 34 are then fitted into the receiving bores 222, 223 that are expanded. After cooling the squeezing rollers, the bearings 31 to 34 are firmly secured to the bearing receiving bores. This prevents the bearings from becoming unstable during rotation of the rollers 22 and thus improves the durability of the bearings. Furthermore, the heating temperature is set within a range of 170 to 190 degrees Celsius, while the heating time is set within a range of 3 to 10 minutes for the shrink fit process of the squeezing rollers. This results in an efficient and optimal performance of the process.

The tube squeezing portion of each squeezing roller 22 has a thickness $\rho$ which is 10 mm or larger. Furthermore, the dimension ratio of this portion to the outer diameter $\epsilon_3$ of the squeezing roller is set within a range of 10 to 40%. This structure increases the temperature gradient between the outer surface and the inner surface of each roller 22. Excessive heating of the bearings is thus prevented. Therefore, the shrink fit rigidity of the bearings is assured to last.

Each squeezing roller 22 includes the outer surface, which expands radially at its middle portion. Therefore, as shown in FIG. 3, when each roller 22 squeezes the elastic tube 24, the force that acts on the bent end portions of a cross section of the tube 24 is smaller than that acting on the middle portion thereof. This structure eliminates local concentration of stress, which acts on the tube 24, and improves the durability of the tube 24.

The dimension ratio ($\phi_2/\phi_1$) of the inner diameter $\phi_2$ to the outer diameter $\phi_1$ of the elastic tube 24 is set within a range of 0.56 to 0.72. Furthermore, the thickness $\eta$ of the elastic tube 24 is set within a range of 23 to 35 mm. This prevents the elastic tube 24 from being pressed toward the inner circumferential surface of the drum 11 when the squeezing rollers 22 start squeezing the tube 24. The elastic tube 24 is thus squeezed at a proper squeezing position. This prevents the elastic tube 24 from being damaged by excessive stress, which acts locally thereon. The durability of the tube is thus improved.

The dimension ratio ($\phi_2/\phi_1$) may be set within a smaller range, that is, within a range of 0.60 to 0.68. This facilitates squeezing of the elastic tube 24 at the proper squeezing position. Therefore, the durability of the tube is further improved.

The elastic tube 24 is constituted by the rubber tube body 40 and the reinforcing layers 41 to 44 that are embedded in the body. This structure improves the durability of the elastic tube. Furthermore, the reinforcing layers 41 to 44 are arranged radially in the tube body 40 with a predetermined interval between one another. The reinforcing layers 41 to 44 extend helically in opposing directions. This further improves the durability of the elastic tube 24.

The reinforcing layers 41 to 44 are formed from the synthetic fiber cords 47. Each synthetic cord includes the plurality of synthetic fibers 45, which are formed from nylon, polyester or the like. With the synthetic fibers 45 arranged in a row, the rubber 46 encompasses their outer surfaces. This structure also improves the durability of the elastic tube 24.

The thickness $\gamma$, which is defined by the inner surface 243 of the elastic tube 24 and the innermost reinforcing layer, or the first reinforcing layer 41 of the rubber body 40, is set within a range of 10 to 15 mm. This structure prevents the foreign body 48 from cutting the reinforcing layer 41 when the foreign body 48 is caught in the elastic tube. Thus, the durability of the elastic tube 24 is further improved.

The present invention is not restricted to this embodiment and may be embodied as follows.

Figure 13:
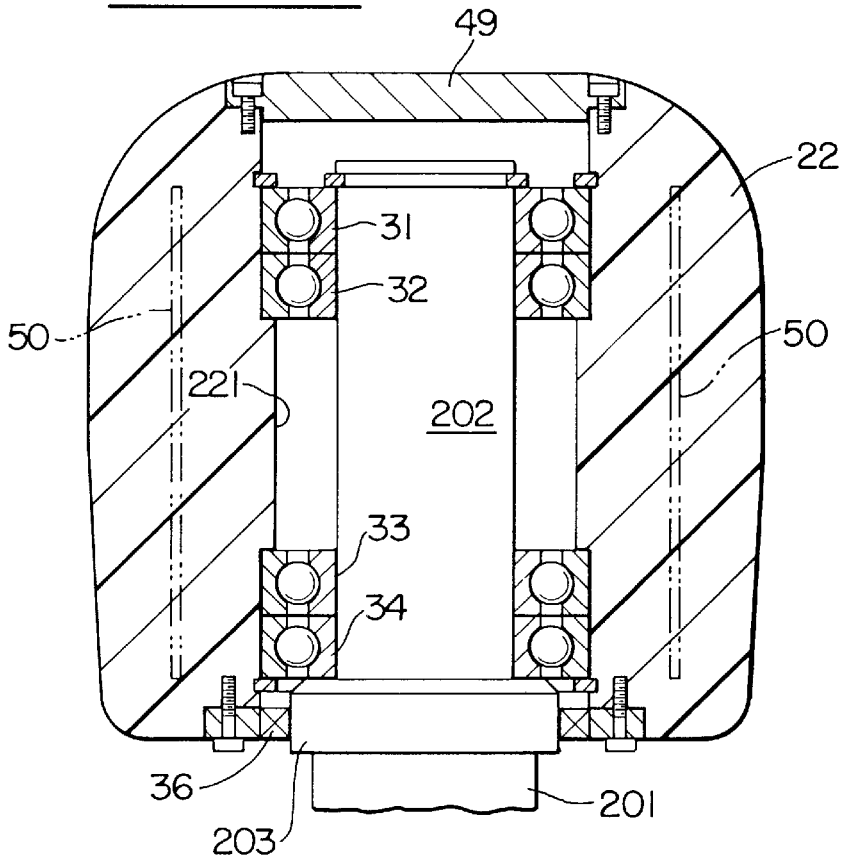
FIG. 13 is a cross-sectional view showing another embodiment of the squeezing roller according to the present invention.

As shown in FIG. 13, the shaft bore 221 may be opened toward the distal end of each squeezing roller 22. Furthermore, the first to fourth bearings 31 to 34 may have the same outer diameter. In such cases, the distal opening of the shaft bore 221 is sealed by a cover plate 49.

As shown in FIG. 13, a heat insulating layer 50 may be formed in another embodiment of the squeezing roller 22. The layer 50 is formed from glass fiber sheet, mica, urethane foam, vinyl chloride foam, or the like. This structure prevents early failure of the bearings 31 to 34 caused by heat. Furthermore, a number of through holes may be provided in the heat insulating layer 50 to allow resin to extend therethrough. This structure communicates resin that is arranged at each side of the heat insulating layer 50 and improves the strength of the rollers.

Figure 14:
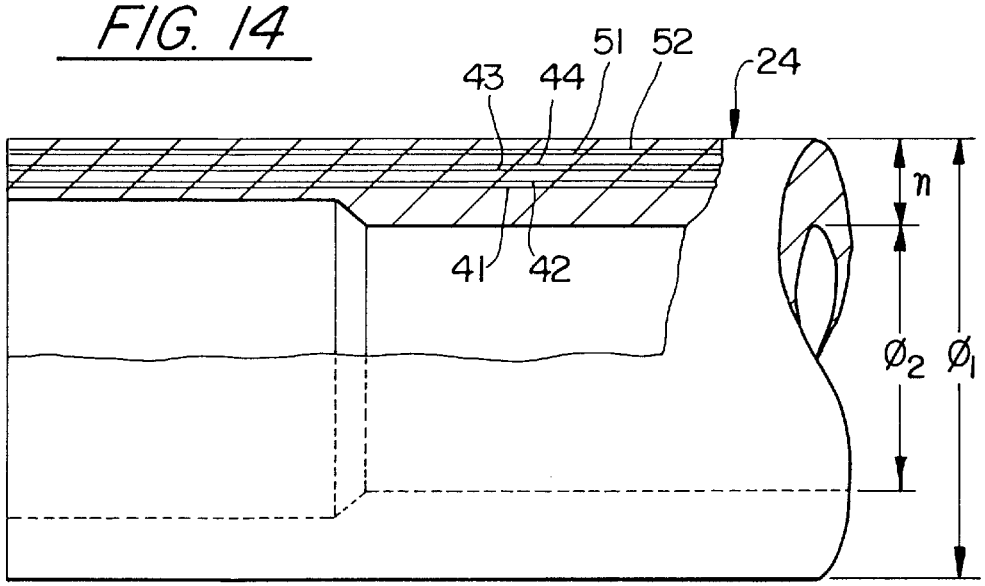
FIG. 14 is a partial cross-sectional view showing another embodiment of the elastic tube.

As shown in FIG. 14, a fifth reinforcing layer 51 and a sixth reinforcing layer 52 may be formed in the elastic tube 24 in addition to the first to fourth reinforcing layers 41 to 44. Alternatively, one, two, three, seven or more reinforcing layers may be formed in the elastic tube 24.

The squeezing rollers 22 may be formed from nylon 66 or polyacetal resin in lieu of the casting nylon. The body 40 of the elastic tube 24 may be formed from nitrile rubber (acrylonitrile-butadiene copolymer), styrene rubber (styrene-butadiene copolymer), acrylic rubber (acrylonitrile-acrylic ester copolymer), polyethylene rubber (chlorosulfonated polyethylene), polyurethane rubber or the like.

Although only one embodiment of the present invention has been described herein, it should be apparent to those skilled in the art that the present invention may be embodied in many other specific forms without departing from the spirit or scope of the invention.

What is claimed is:

1. A squeeze type pump that transfers slurry via an elastic tube by squeezing the elastic tube with pairs of rollers to elastically deform the tube while moving each pair of squeezing rollers, comprising:

a cylindrical drum;

the elastic tube being arranged along an inner surface of the drum;

a drive shaft supported at a center portion of the drum;

pairs of support shafts cantilevered by the drive shaft, and bearings rotatably supporting the rollers on each support shaft;

wherein the squeezing rollers are formed from a synthetic resin material and define receiving bores for receiving the bearings, the bearings being shrink fitted into said receiving bores.

2. The squeeze type pump as set forth in claim 1, wherein the squeezing rollers are formed by charging the synthetic resin material in metal molds and then polymerizing the synthetic resin material afterward.

3. The squeeze type pump as set forth in claim 2, wherein the squeezing rollers formed from the synthetic resin material have a heat conductivity that is set within a range of 4.8 to $6.4\times10^{-4}$cal/cm ° C. sec.

4. The squeeze type pump as set forth in claim 3, wherein the squeezing rollers formed from the synthetic resin material have a Rockwell hardness that is set within a range of 105 to 125.

5. The squeeze type pump as set forth in claim 4, wherein the squeezing rollers formed from the synthetic resin material have a heat resisting temperature that is set within a range of 120 to 170 degrees Celsius.

6. The squeeze type pump as set forth in claim 5, wherein the squeezing rollers formed from the synthetic resin material have a compressive strength that is set within a range of 700 to 1300 kg/cm.

7. The squeeze type pump as set forth in claim 1, wherein the shrink fitting includes heating the squeezing rollers to a temperature higher than a maximal use temperature thereof to expand the receiving bores, inserting the bearings in the expanded receiving bores, and cooling the squeezing rollers and the bearings.

8. The squeeze type pump as set forth in claim 1, wherein a shrink-fit allowance K1 (%) between the squeezing rollers and the bearings is determined by the following equation (1):

$$K1=Ko+0.01(t_{max}-t_{min})<1.0\% \quad (1);$$

wherein Ko (%) indicates a standard shrink fit allowance, while $t_{max}$ indicates the maximal use temperature(° C.) of the squeezing rollers and $t_{min}$ indicates a minimal use temperature(° C.) thereof, said Ko (%) is determined by the following equation (2):

$$Ko=\text{standard shrink fit dimension/outer diameter of bearings}\times100 \quad (2);$$

wherein the standard shrink fit dimension is determined by subtracting an inner diameter of the receiving bore from an outer diameter of the bearing and then dividing the obtained value by two.

9. The squeeze type pump as set forth in claim 8, wherein the standard shrink fit allowance is set within a range of 0.3 to 0.6%.

10. The squeeze type pump as set forth in claim 9, wherein a heating temperature is set within a range of 170 to 190 degrees Celsius and a heating time is set within a range of 3 to 10 minutes during the shrink fitting.

11. The squeeze type pump as set forth in claim 1, wherein operating portions are provided on the squeezing rollers for pressing the elastic tube, said operating portion having a thickness that is 10 mm or larger, and wherein a dimension ratio of an outer diameter of the operating portion to an outer diameter of the squeezing rollers is set within a range of 0.1 to 0.4.

12. The squeeze type pump as set forth in claim 2, wherein the synthetic resin material is a monomer casting nylon, and the squeezing rollers formed from the material have wear-resistant, heat-resistant, and impact-resistant properties.

13. The squeeze type roller as set forth in claim 1, further comprising:

attachment plates mounted on the drive shaft;

a plurality of support arms cantilevered to the mounting plates;

restricting rollers rotatably supported to each support shaft for restricting a position of the elastic tube when engaged with the elastic tube; and restoring rollers attached to the attachment plates for restoring the elastic tube, which has been compressed by the squeezing rollers.

14. The squeeze type pump as set forth in claim 1, wherein a ratio of an inner diameter to an outer diameter of the elastic tube is set within a range of 0.56 to 0.72, and a thickness of the elastic tube is set within a range of 23 to 35 mm.

15. The squeeze type pump as set forth in claim 14, wherein the ratio of the inner diameter to the outer diameter of the elastic tube is set within a range of 0.6 to 0.8.

16. The squeeze type pump as set forth in claim 14, wherein the thickness of the elastic tube is set within a range of 28 to 30 mm.

17. The squeeze type pump as set forth in claim 11, wherein the elastic tube includes a rubber tube body and reinforcing layers embedded in the tube body.

18. The squeeze type pump as set forth in claim 17, wherein the reinforcing layers are arranged radially in the tube body with a predetermined interval between one another, and the reinforcing layers extend helically in opposite directions.

19. The squeeze type pump as set forth in claim 18, wherein an angle defined by the reinforcing layers and the axis of the tube body is set within a range of about 50 to about 60 degrees.

20. The squeeze type pump as set forth in claim 19, wherein the reinforcing layers include a plurality of threads arranged with an interval between one another and rubber encompassing each thread, the threads being formed from one of nylon and polyester.

21. The squeeze type pump as set forth in claim 20, wherein a thickness of the tube body defined between an inner surface of the elastic tube and the reinforcing layers is set within a range of 10 to 15 mm.

22. The squeeze type pump as set forth in claim 17, wherein the tube body is formed from rubber that has wear-resistant and weather-resistant properties, the rubber being formed from materials including 50 parts by weight of natural rubber, 50 parts by weight of styrene-butadiene rubber, 50 parts by weight of carbon black, 5 parts by weight of zinc white, 5 parts by weight of softener, 3 parts by weight of processing aid, 2 parts by weight of sulfur, 1 part by weight of vulcanization accelerator, 2 parts by weight of stearic acid, and 1 part by weight of antioxidant.

23. The squeeze type pump as set forth in claim 1, wherein cylindrical heat insulating layers are embedded in the squeezing rollers.

* * * * *

UNITED STATES PATENT AND TRADEMARK OFFICE

CERTIFICATE OF CORRECTION

PATENT NO. : 5,954,486

DATED : September 21, 1999

INVENTOR(S) : IWATA

It is certified that error appears in the above-identified patent and that said Letters Patent is hereby corrected as shown below:

In column 6, line 31, replace "$\not{\rho}$ (mm)" with --$\rho$ (mm)--.

Signed and Sealed this

Fifteenth Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,954,486

DATED : September 21, 1999

INVENTOR(S) : Noboru Iwata

It is certified that error appears in the above-identified patent and that said Letters Patent is hereby corrected as shown below:

On the title page, item [54] and column 1, line 1:

In the title: "SQUEEZE PUMP HAVING SHRINK FITTER ROLLERS" should read --Squeeze Pump Having Shrink Fitted Rollers--.

In column 6, line 31, replace "ϟ (mm)" with --ρ (mm)

Signed and Sealed this

Twelfth Day of December, 2000

*Attest:*

Q. TODD DICKINSON

*Attesting Officer*

*Director of Patents and Trademarks*